United States Patent [19]

Elmer

[11] Patent Number: 4,839,975

[45] Date of Patent: Jun. 20, 1989

[54] LIGHTING SYSTEM FOR CAR TOP SIGN

[76] Inventor: William A. Elmer, 917 N. Pennsylvania Ave., Winter Park, Fla. 32789

[21] Appl. No.: 55,993

[22] Filed: Jun. 1, 1987

[51] Int. Cl.[4] ..... G09F 21/04

[52] U.S. Cl. ..... 40/592; 40/564

[58] Field of Search ..... 40/564, 152.2, 592, 40/591

[56] References Cited

U.S. PATENT DOCUMENTS

| | | | |
|---|---|---|---|
| 1,700,383 | 1/1929 | Smigielski | 40/564 |
| 4,667,428 | 5/1987 | Elmer | 40/592 |
| 4,671,004 | 6/1987 | Berg | 40/564 |
| 4,688,343 | 8/1987 | Allan | 40/591 |

FOREIGN PATENT DOCUMENTS

| | | | |
|---|---|---|---|
| 248832 | 1/1964 | Australia | 40/564 |

*Primary Examiner*—Gene Mancene
*Assistant Examiner*—Wenceslao J. Contreras
*Attorney, Agent, or Firm*—Macdonald J. Wiggins

[57] ABSTRACT

A lighting system for a translucent plastic car top sign having three side panels forming a truncated triangular pyramid and a top is disclosed. A convex reflector surface depends from the top and has three electric lamps oriented to be aligned with the apexes of the triangular pyramid such that each panel is illuminated by overlapping of direct and reflected light from the lamps. A translucent diffuser dome may be disposed over the reflector and lamps.

3 Claims, 1 Drawing Sheet

LIGHTING SYSTEM FOR CAR TOP SIGN

BACKGROUND OF THE INVENTION

1. Field of the Invention

The present invention relates to a lighting system, and more particularly to a lighting system for a translucent triangular car top sign which will produce even lighting of the sign area.

2. Description of the Prior Art

In U.S. Pat. No. 4,667,428, an improved car top sign is disclosed. The sign includes a hollow triangular truncated pyramid formed from a translucent plastic such as polycarbonate sheet, and a triangular base flange with means for attaching the sign to the roof of an automobile or like vehicle. The sign is utilized for advertising; for example, a delivery service for which the vehicle is being used. In delivering fast foods, such as pizza, night delivery is common and means for brightly illuminating the sign is desired. The sign holder of the above-referenced patent includes a 12 volt automobile-type lamp attached in the center of the top of the truncated pyramid. A lead is brought out and plugged into a cigarette lighter or other electrical connection in the vehicle. Although such lighting means is somewhat effective, a single bulb tends to produce hot spots or bright areas in the centers of the translucent panels forming the sides of the truncated pyramid.

Thus, there is a need for a low cost lighting system which will more evenly illuminate the side panels of a sign of the above-described type without producing hot spots.

SUMMARY OF THE INVENTION

The present invention is a light system having three 12 volt automobile-type bulbs. A reflector is provided which is preferably circular and is mounted to the center of the top surface of a triangular truncated pyramid sign holder. The reflector has an essentially convex surface. Three lamp sockets are disposed on the convex surface in a circle having a radius of about one half that of the reflector, concentric with the reflector, and spaced at the 120° points. The surface of the reflector is made reflective. The reflector assembly is mounted in the center of the top surface of the truncated pyramid with the lamp sockets and lamps depending therefrom. The reflector is oriented such that each bulb is aligned with a corner of the truncated pyramid.

The lamp sockets are connected in parallel and a cord provided for connection to the 12 volt battery system of a vehicle. Each bulb will produce a pattern of light of somewhat less than 180° such that the pattern from one bulb will overlap the pattern of the adjacent bulb. Thus, each panel of the triangular sign holders will be completely illuminated from edge to edge. The curvature of the reflector also ensures that the vertical pattern of light will cover the entire vertical aspect of each panel.

In addition to the effect of the overlapping light patterns from each bulb, in many instances it may be desirable to utilize a diffuser dome over the reflector. To that end, the invention provides a dome molded from a translucent plastic having a plurality of small tabs around the periphery of the base of the dome. Slots matching the tabs are provided in a circumferential rim of the reflector such that these tabs may be snapped into the slots to hold the diffuser in place. The diffuser has the function of providing a more even lighting of the signs.

It is therefore a principal object of the invention to provide an improved lighting system for a plastic triangular truncated pyramidal sign which will evenly illuminate three translucent sides thereof forming sign panels.

It is another object of the invention to provide a lighting system for such signs which can be produced at low cost containing three lamps and a convex reflector.

It is yet another object of the invention to provide a light system for mounting to the top of a triangular truncated pyramidal plastic sign in which three lamps are evenly spaced around a convex reflector and oriented with the corners of the pyramidal sign holder.

These and other objects and advantages of the invention will become apparent from the following detailed description when read in conjunction with the drawings.

DETAILED DESCRIPTION OF THE PREFERRED EMBODIMENT

Figure 1:
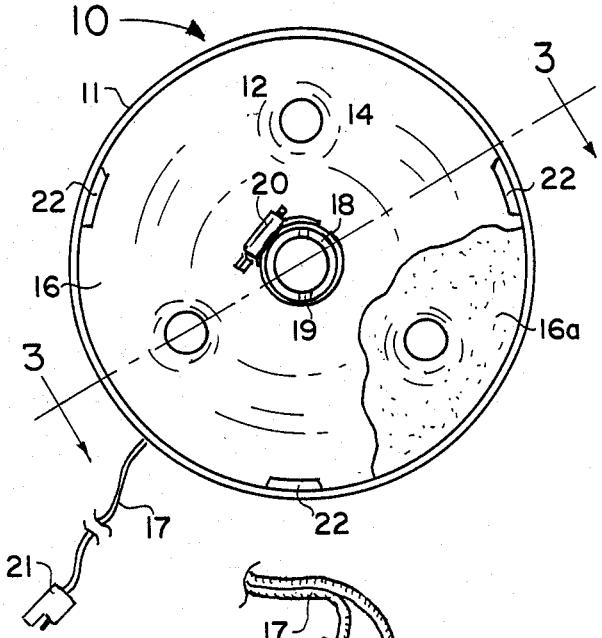
FIG. 1 is a plan view of the reflector assembly and lamps of the invention.
Figure 3:
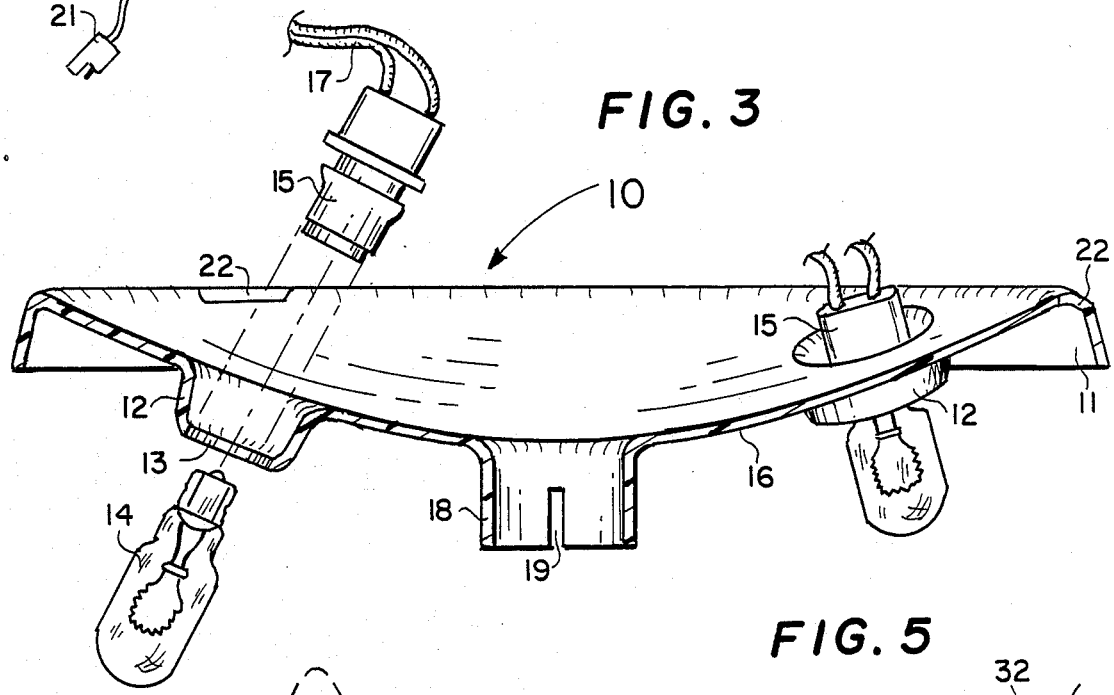
FIG. 3 is a cross-sectional view of the reflector of FIG. 1 inverted from its normal position.

FIG. 1 shows a plan view of the reflector 10 of the preferred embodiment of the invention with FIG. 3 showing a cross-sectional view thereof through the plane 3—3. The reflector may be made from any suitable material such as metal or plastic, although it is preferred that a lightweight thin plastic such as polycarbonate be used for ease of molding, lightweight and low cost. Convex reflector surface 16 includes a set of three lamp socket bosses 12. As will be noted from FIG. 1, bosses 12 are disposed 120° apart around reflector surface 16. The central portion of reflector 10 includes a clamping sleeve 18 having a pair of slots 19 therein. As may be noted from FIG. 1, a hose clamp is placed around clamping sleeve 18 which is installed on a post within a car top sign and tightened to securely mount the reflector 10. A rim 11 is provided around the periphery of reflector surface 16. The reflector surface 16 may be formed from a plastic having a reflective color such as white, or it may be coated with a reflective metallic plating such as indicated at **16*a* in FIG. 1**.

An automotive type lamp socket 15 is inserted through opening 13 in each lamp housing boss 12 and secured with a suitable cement. Electrical leads 17 from lamp socket 15 are connected in parallel with the leads from the other two lamp sockets and connected to a plug 21. A lamp bulb 14 is inserted into lamp socket 15. The vehicle with which the sign is to be used is provided with a mating connector for plug 21 and connected into the 12 volt system of the vehicle.

Figure 2:
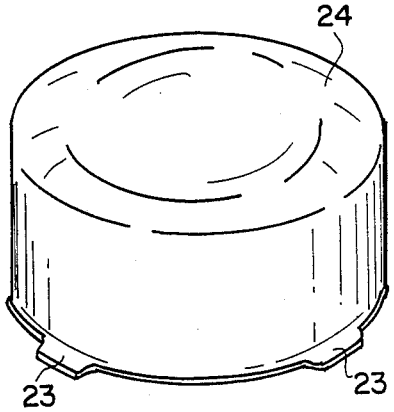
FIG. 2 is a perspective view of a diffuser dome for installation on the reflector of FIG. 1.

As will now be understood, the reflector 10 is mounted to the center of the top of a triangular truncated pyramidal plastic car top sign holder with lamp bulbs 14 depending from reflector 10. When the lamp system is to be used with a sign holder having relatively dense transparent printing thereon, the reflector may be utilized as shown in FIGS. 1 and 3. However, when the sign panels are relatively transparent or lightly translucent, a diffuser may be desirable. FIG. 2 shows a perspective view of a suitable diffuser 24. Diffuser 24 is preferably formed from thin, translucent white plastic although tinted plastic may be used if desired. Mounting tabs 23 extend from the base portion of diffuser 24. Rim 11 of reflector 10 includes a plurality of slots 22 which are spaced to match the location of tabs 23 of diffuser 24. Due to the flexibility of the plastic from which diffuser 24 is formed, tabs 23 may be snapped into slots 22 after attachment of reflector 10 to the sign holder and installation of lamps 14.

Figure 4:
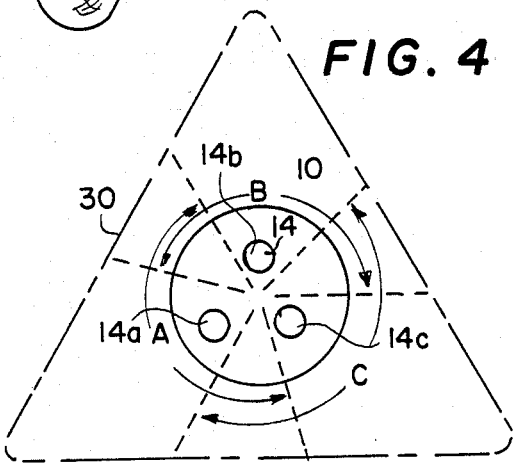
FIG. 4 is a diagram showing the orientation of the reflector of FIG. 1 in a triangular sign and indicating the overlapping light patterns from the lamps thereof.
Figure 5:
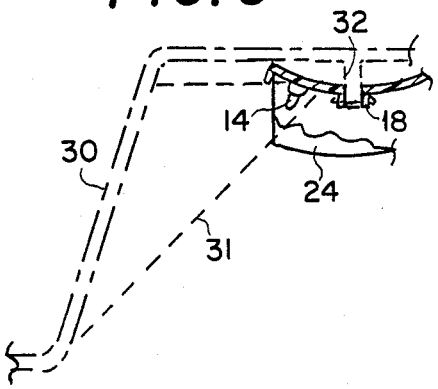
FIG. 5 is a vertical partial cross-section through a sign shown in phantom view illustrating the illumination of the face of the sign by the reflector assembly of FIG. 1.

Turning now to FIGS. 4 and 5, the light patterns of the invention will be shown. In FIG. 4, reflector 10 is shown with lamps 14*a*, 14*b*, and 14*c*. As will be noted, reflector 10 is oriented such that the lamps are aligned with the corners of the triangular truncated pyramidal sign shown in phantom view at 30. The arc shown by arrows A indicates an approximate extent of the direct and reflected light from lamp 14*a* which will fall off in intensity toward the limit of the direct and reflected light. Similarly, arcs indicated by arrows B and C show the patterns from lamps 14*b* and 14*c*, respectively. As will be noted these areas overlap, contributing to a relatively even illumination of the sides of sign 30. FIG. 5 illustrates the vertical light pattern obtained from curved reflector 10 mounted to post 32 of sign 30. The curvature of reflector 10 causes light to be directed to the base of sign 30 while direct illumination is provided to the upper part of panel 30.

As will now be recognized, a light system has been provided for a car top sign having three translucent sign panels and which will provide relatively even and diffused lighting over the entire surfaces of the panels. Although a specific structure has been disclosed, it is to be understood that it is for exemplary purposes only and various modifications may be made thereto without departing from the spirit and scope of the invention.

I claim:

1. A lighting fixture for a car top sign, said sign formed as a triangular truncated pyramid having three faces of a translucent material for bearing a message and a triangular top surface, comprising:

a circular reflector having a convex surface thereof for efficient reflection of light, said reflector symmetrically attached to an interior surface of said triangular top surface;

three electric lamps in which each lamp depends from said convex surface opposite each respective apex of said triangular truncated pyramid and positioned to illuminate each of the adjacent faces of said truncated pyramid;

electrical connection leads from said lamp for connection to a source of electrical power; and each of said faces thereby receiving overlapping reflected and direct illumination from two of said lamps, the curvature of said convex surface selected to concentrate light from said lamps on said panels.

2. The fixture as recited in claim 1 in which said triangular top surface includes a centralized depending stud, which further comprises:

a central clamping sleeve disposed on said stud and clamped thereto.

3. The fixture as recited in claim 1 which further comprises a diffuser dome for enclosing said reflector and said lamps.

* * * * *